US008936097B2

(12) United States Patent
Heijnen

(10) Patent No.: US 8,936,097 B2
(45) Date of Patent: Jan. 20, 2015

(54) METHOD AND AN APPARATUS FOR DOWNHOLE INJECTING ONE OR MORE TREATMENT FLUIDS

(75) Inventor: Wilhelmus Hubertus Paulus Maria Heijnen, Stromberg (DE)

(73) Assignee: Maersk Olie OG Gas A/S, Copenhagen K (DK)

( * ) Notice: Subject to any disclaimer, the term of this patent is extended or adjusted under 35 U.S.C. 154(b) by 568 days.

(21) Appl. No.: 12/920,298

(22) PCT Filed: Mar. 4, 2009

(86) PCT No.: PCT/EP2009/052554
§ 371 (c)(1),
(2), (4) Date: Nov. 29, 2010

(87) PCT Pub. No.: WO2009/109599
PCT Pub. Date: Sep. 11, 2009

(65) Prior Publication Data

US 2012/0085540 A1 Apr. 12, 2012

Related U.S. Application Data

(60) Provisional application No. 61/034,251, filed on Mar. 6, 2008.

(30) Foreign Application Priority Data

Mar. 6, 2008 (DK) ..... 2008 00331

(51) Int. Cl.
*E21B 27/00* (2006.01)
*E21B 27/02* (2006.01)
(Continued)

(52) U.S. Cl.
CPC ..... *E21B 27/02* (2013.01); *E21B 33/1208* (2013.01); *E21B 43/26* (2013.01)
USPC ..... 166/381; 166/305.1; 166/162; 166/242.1

(58) Field of Classification Search
USPC ..... 166/305.1, 381, 162, 242.1
See application file for complete search history.

(56) References Cited

U.S. PATENT DOCUMENTS 2,631,673 A 3/1953 Halderson et al.
2,769,498 A 11/1956 Huber
(Continued)

FOREIGN PATENT DOCUMENTS

EP 0819830 A2 1/1998
EP 0898050 A1 2/1999
(Continued)

OTHER PUBLICATIONS

International Search Report for PCT/EP2009/52554, mailed Jun. 8, 2009.
(Continued)

*Primary Examiner* — Jennifer H Gay
*Assistant Examiner* — Elizabeth Gitlin
(74) *Attorney, Agent, or Firm* — Brinks Gilson & Lione

(57) ABSTRACT

A method for downhole injecting treatment fluids, and for providing in an annular space between a well tubular and the surrounding formation or between pipes of a wellbore system, includes loading the treatment fluids into separate fluid containers that are arranged in an injection tool. Each container includes container walls that surround the fluid in the fluid container, and an outlet opening. The method also includes lowering the injection tool body into the wellbore or the well tubular to a predetermined position, and then pumping the fluids from each fluid container into the wellbore or the well tubular.

16 Claims, 1 Drawing Sheet

(51) Int. Cl.
*E21B 33/12* (2006.01)
*E21B 43/26* (2006.01)

(56) References Cited

U.S. PATENT DOCUMENTS

| | | | | |
|---|---|---|---|---|
| 3,379,251 | A | 4/1968 | Bohn | |
| 3,614,988 | A * | 10/1971 | Moore | 166/193 |
| 3,727,691 | A | 4/1973 | Muecke et al. | |
| 4,064,941 | A | 12/1977 | Smith | |
| 4,417,625 | A | 11/1983 | Henson et al. | |
| 4,462,714 | A | 7/1984 | Smith | |
| 4,739,829 | A | 4/1988 | Brunner | |
| 4,913,232 | A | 4/1990 | Cheymol et al. | |
| 4,943,610 | A | 7/1990 | Sayles | |
| 4,972,906 | A | 11/1990 | McDaniel | |
| 5,028,213 | A * | 7/1991 | Dickinson et al. | 417/118 |
| 5,240,074 | A | 8/1993 | Peavy et al. | |
| 5,404,946 | A | 4/1995 | Hess | |
| 5,582,251 | A | 12/1996 | Bailey | |
| 6,196,315 | B1 | 3/2001 | Surles et al. | |
| 6,616,716 | B2 | 9/2003 | Hansen | |
| 6,848,519 | B2 | 2/2005 | Reddy et al. | |
| 6,955,216 | B1 | 10/2005 | Heijnen | |
| 7,306,033 | B2 | 12/2007 | Gorrara | |
| 7,523,785 | B2 | 4/2009 | Brink et al. | |
| 2001/0027868 | A1 | 10/2001 | Carisella | |
| 2006/0027371 | A1 | 2/2006 | Gorrara | |
| 2006/0102336 | A1 | 5/2006 | Campbell | |
| 2006/0144593 | A1 | 7/2006 | Reddy | |
| 2006/0185855 | A1 | 8/2006 | Jordan | |
| 2006/0234871 | A1 | 10/2006 | Dalrymple et al. | |
| 2007/0114016 | A1 | 5/2007 | Brezinski | |
| 2007/0209797 | A1 | 9/2007 | Brink et al. | |

FOREIGN PATENT DOCUMENTS

| | | | |
|---|---|---|---|
| EP | 1223303 | A1 | 7/2002 |
| EP | 1 653 042 | A1 | 5/2006 |
| EP | 1 653 043 | A1 | 5/2006 |
| GB | 2153409 | A | 8/1985 |
| GB | 2 300 015 | A | 4/1996 |
| WO | 2005/078235 | A1 | 8/2005 |
| WO | 2006/008490 | A1 | 1/2006 |
| WO | 2006/079659 | A1 | 8/2006 |
| WO | 2006/084597 | A1 | 8/2006 |
| WO | 2007/022834 | A1 | 3/2007 |
| WO | 2007/101444 | A2 | 9/2007 |
| WO | 2007/124041 | A2 | 11/2007 |

OTHER PUBLICATIONS

Written Opinion for PCT/EP2009/52554, mailed Jun. 8, 2009.
International Preliminary Report on Patentability for PCT/EP2009/52554, mailed May 25, 2010.
Kipp, Dale 0., Plastic Material Data Sheets, 2004; 2010, MatWeb, LLC.
International Search Report and Written Opinion for PCT/EP2009/052613, mailing date of Jul. 16, 2010.
International Search Report and Written Opinion for PCT/EP2009/052871, mailing date of Jan. 13, 2011.

* cited by examiner

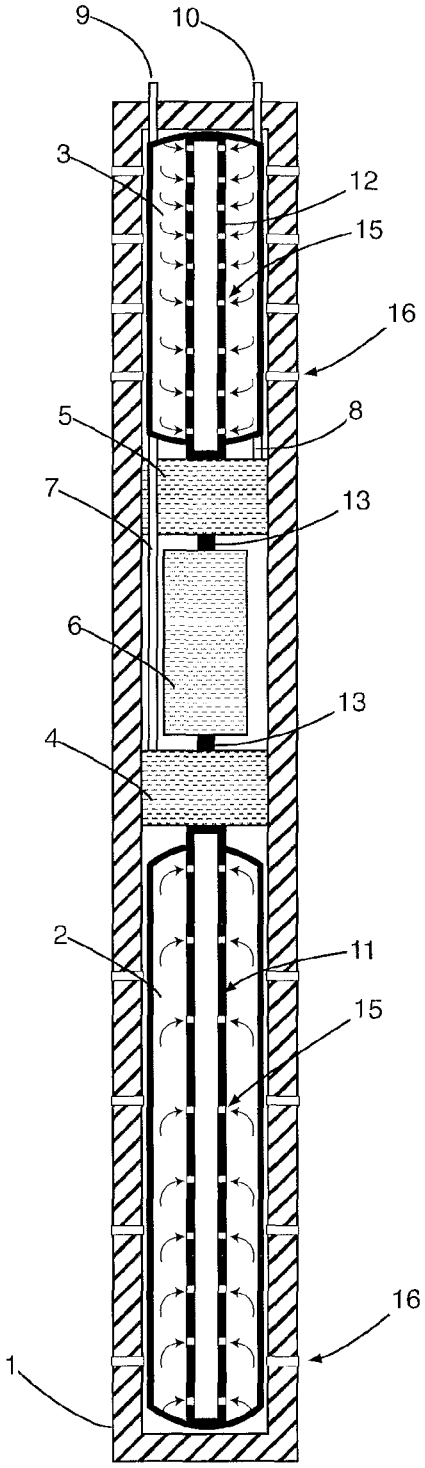
9
10
3
12
15
16
5
8
7
13
6
13
4
2
11
15
16
1

METHOD AND AN APPARATUS FOR DOWNHOLE INJECTING ONE OR MORE TREATMENT FLUIDS

This application claims the benefit under 35 U.S.C. §371 of International Application No. PCT/EP2009/052554, filed Mar. 4, 2009, which claims priority to U.S. Provisional Application No. 61/034,251, filed Mar. 6, 2008 and Danish Application No. PA 2008 00331, filed Mar. 6, 2008, the contents of all of which are incorporated herein by reference in their entirety.

FIELD OF THE INVENTION

The present invention relates to the field of oil recovery from a wellbore.

BACKGROUND OF THE INVENTION

For oil recovery a well is drilled and a well tubular such as a casing or a liner is introduced into the well. The outside diameter of the well tubular is smaller than the inside diameter of the wellbore, thereby forming an annular space between the well tubular and the wellbore. The well tubular is perforated at one or more zones in order to facilitate the flow of hydrocarbons into the tubular and subsequent flow upstream for recovery. Occasionally contaminating materials such as water and sand are produced along with the hydrocarbons from a part of the subterranean formations surrounding the well tubular. In these situations it is desirable to seal off the well tubular from one or more parts of the annular space. Also in other situation it may be desirable to seal off the annular space.

To seal off a desired part of, e.g., a well one possibility is to isolate the internal part of the well tubular using temporary packers. Cement or another harden able composition is then pumped down to the isolated zone to seal the perforated openings in the desired part of the well tubular. If production is subsequently desired from a zone situated further downstream in the casing, removal or penetration of the seal is required.

In the past the placing of a "treatment fluid", e.g. an acid, a polymer, or cement, within a wellbore has been accomplished by use of a "bailer" which is introduced into the well on a wire line or the like. The bailer contains a specific volume and is possible to activate due to density differential of the treatment fluid relative to the natural fluids present in the wellbore at the time and location of treatment. Even modified bailer systems do not satisfactorily deliver a predetermined amount of a treatment fluid at the exact location, especially in highly deviated wells or in the well tubular which has become "corkscrewed". Thus, a number of other systems have been devised for deploying a "treatment fluid" at a proper location for e.g. providing a seal.

U.S. Pat. No. 6,955,216 disclose a device for injecting a fluid into an earth formation surrounding a well. The device comprises a body suitable for being arranged in a well bore and provided with a fluid chamber for storage of suitable sealant and a pair of inflatable packers arranged to isolate a portion of the well bore between the packers upon inflating the packers. The suitable sealant in then injected by means of piston working under pressure against the surrounding pressure into the formation through perforations isolated between the packers. The sealant composition is disclosed to be a suitable material, such as a vulcanised or unvulcanised rubber composition.

U.S. Pat. No. 4,972,906 disclose the use of a mixture of a liquid epoxy material and a hardener for plugging a zone in a subterranean zone. The epoxy material used is heavier than the fluid in the well, and it is further characterized as being free of solids and having a low viscosity at downhole temperature and pressure. The material is placed in a well by the use of a positive displacement bailer.

U.S. Pat. No. 5,582,251 disclose a downhole mixer having separated compartments for containing two or more different compounds to be mixed in situ downhole. This downhole mixer comprises a piston arranged for both breaking a sealing between each compartment, and for driving the mixed constituents through an outlet against the downhole surrounding pressure into the wellbore for providing a bridge plug, a packer or other downhole function.

It is evident that it is important to place seals, plugs and the like in the correct position and to ensure proper mixing of the constituents to ensure their correct function, and therefore there is an ongoing process of developing new and improved apparatuses and procedures for introducing seals or plugs or the like in a well, and especially in an annular space between a well tubular and the surrounding formation.

SUMMARY OF THE INVENTION

In accordance with the invention there is provided a method and an apparatus for downhole injecting one or more treatment fluids, and especially for providing one or more seals in an annular space between a well tubular and the surrounding formation or between pipes of a wellbore system, said method comprising the steps of a) loading the or each treatment fluid separately into one or more fluid containers arranged in a injecting tool, each container comprising container walls surrounding the fluid in the fluid container, and an outlet opening.
b) lowering the injecting tool body into the wellbore or the well tubular to a predetermined position,
c) exposing at least part of the outside of the fluid container walls to the surrounding pressure in the wellbore,
d) Allowing at least part of each of the fluid containers walls to displace within the depositing tool body under forces exerted on the fluid container walls by the surrounding pressure in the wellbore.
e) Pumping the fluids from each fluid container into the wellbore or the well tubular.

It is hereby achieved that the precise mixing and positioning of the fluids are possible without using heavy loaded pumps and motors, due to the high downhole surrounding pressure acting to help driving fluids out of the containers.

The invention is especially advantageous in an embodiment where at least two different fluids, such as a basic component and its curing or expanding component are to be injected downhole, whereby each fluid is pumped out of each fluid container in a predetermined volume relative to each other.

In order to avoid the components reacting with each other in the pumps, it is advantageous to use separate pumps connected to each fluid container.

In order to ensure correct mixing of the fluids, a number of further preferred embodiments are disclosed In this respect it is especially advantageous to use positive displacement pumps for pumping each fluid, and to use a single motor for driving all the pumps.

Preferably the pumps are each having a drive shaft connected to the single motor for driving each pump, and wherein the pumps are selected having a pre-determined displacement of fluids per revolution of the drive shaft being relative to each other by the same ratio as defined by the pre-determined volume of the fluids.

In a further advantageous embodiment the fluid containers has container walls being elastic or plastic deformable and being collapsible under the surrounding pressure in the wellbore. Especially the fluid container can be made as a disposable or refillable cartridge having a pipe having a first end extending inside the fluid container and through the container wall, and another end on the outside of the container, the other end of the pipe forming the outlet of the fluid container.

I this relation it is preferable if a plurality of holes are made in the pipe at different positions along its first end in order to allow fluid in the fluid container to enter into the pipe, and thereby avoiding the elastic or collapsible wall blocking the fluid stream.

In a further preferred embodiment the fluid containers, and the pumps and motor are arranged inside an injection tool casing for protection, and where the injection tool casing is having openings allowing ambient pressure to reach at least part of the inside of the injecting tool casing containing the fluid containers.

According to the invention, a downhole injecting tool is also suggested for injecting at least one fluid at a pre-determined position in a wellbore and especially for providing one or more seals in an annular space between a well tubular and the surrounding formation or between pipes of a wellbore system, said downhole injecting tool comprising at least one fluid container each having a fluid container outlet connected to a pump and a motor arranged for pumping fluid out of the container and into the wellbore, and where each fluid container comprises container walls surrounding the fluid in the container, and wherein the injecting tool is constructed such that at least part of the outside of the container walls are open to the ambient pressure surrounding the injecting tool, and that the above mentioned at least part of the outside of the container walls is displaceable within the injecting tool.

BRIEF DESCRIPTION OF THE DRAWINGS

The invention will now be described in more detail wait reference to the drawing FIG. 1 showing schematically a longitudinal section of the downhole injecting tool 1 according to the present invention

DETAILED DESCRIPTION OF THE PREFERRED EMBODIMENT

The injection system according to FIG. 1 comprises a casing 1 having a cross section so that the complete casing 1 can be lowered into a wellbore, or an inner lining in a wellbore (not shown). Normally the cross section of the casing 1 would be cylindrical, but other cross sections may be used within the scope of the invention. In the casing are arranged two cartridges 2 and 3, each containing fluid to be injected into the wellbore or inner lining in the wellbore.

The casing 1 also contains two pumps 4, 5 being connected respectively to the cartridges 1, 3 via the pipes 11, 12 extending from inside each cartridge 2, 3 respectively and to the inlet of each pump 4, 5. From each pump 4, 5 is arranged an outlet pipe 7, 8 respectively extending along the inside of the casing 1 an past the cartridge 3 and further through the casing 1 where the pipes 7, 8 end outside the casing 1 defining fluid outlets 9, 10 for injecting fluids to the wellbore or the inner lining in a wellbore.

Inside the cartridges 2, 3 the pipes 11, 12 have a plurality of holes 15, allowing the fluid in each cartridge to enter the pipes 11, 12.

The pumps 4, 5 are driven through driveshaft 13 by means of a single electrical motor 6, and the motor 6 can be operated and controlled from outside by means of control and/or power wiring or by wireless signaling combined with an internal electrical power pack arranged in the motor. Many different solutions to controlling the motor can be suggested without departing from the idea of the invention, and therefore such means are not disclosed in the drawing.

Upon activation the electrical motor 6 and the pumps 4, 5, will be able to pump fluids from the cartridges 2, 3 and out of the casing 1 via the fluid outlets 9, 10.

According to the invention a plurality of holes 16 are made in the casing 1, so that the inside of the casing 1 gets the same hydrostatical pressure as the pressure in the wellbore, so that this pressure helps emptying the cartridges 2, 3.

A person skilled in the art would appreciate that the injection tool is possible to construct using a very limited number of components when using a single motor 6 driving both pumps 2, 3, and especially when using positive displacement pumps 2, 3 because this on the one side makes it possible to avoid separate valves for retaining the fluids in the cartridges during lowering of the casing into a wellbore or an inner liner in the wellbore, and on the other side ensures exact mixing of the fluids with the correct mixing ratio when the pumps are selected having a displacement ratio per revolution of the driveshaft 13 being the same as the selected mixing ratio of the fluids.

Even though FIG. 1 discloses an injecting tool having two separated cartridges, the present invention is also applicable to injecting tools having one or more than two cartridges in the casing as well as the necessary pumps for each cartridge. Similar designs can therefore be made for fluid systems consisting of a single or more than two components.

All references, including publications, patent applications, and patents, cited herein are hereby incorporated by reference in their entirety and to the same extent as if each reference were individually and specifically indicated to be incorporated by reference and were set forth in its entirety herein, regardless of any separately provided incorporation of particular documents made elsewhere herein.

The use of the terms "the", "a", "an" and similar referents in the context of describing the invention are to be construed to cover both the singular and the plural, unless otherwise indicated herein or clearly contradicted by context.

Unless otherwise stated, all exact values provided herein are representative of corresponding approximate values (e.g., all exact exemplary values provided with respect to a particular factor or measurement can be considered to also provide a corresponding approximate measurement, modified by "about," where appropriate).

The description herein of any aspect or embodiment of the invention using terms such as "comprising", "having," "including," or "containing" with reference to an element or elements is intended to provide support for a similar aspect or embodiment of the invention that "consists of", "consists essentially of", or "substantially comprises" that particular element or elements, unless otherwise stated or clearly contradicted by context (e.g., a composition described herein as comprising a particular element should be understood as also describing a composition consisting of that element, unless otherwise stated or clearly contradicted by context).

All headings and sub-headings are used herein for convenience only and should not be construed as limiting the invention in any way.

The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

The citation and incorporation of patent documents herein is done for convenience only and does not reflect any view of the validity, patentability, and/or enforceability of such patent documents.

This invention includes all modifications and equivalents of the subject matter recited in the claims and/or aspects appended hereto as permitted by applicable law.

The invention claimed is:

1. A method for sealing an annular space between a well tubular and the surrounding formation or between pipes of a wellbore, said method comprising the steps of a) loading one or more treatment fluids separately into one or more fluid containers arranged in an injecting tool body that surrounds the one or more fluid containers, each of the one or more fluid container comprising container walls surrounding the one or more treatment fluids in the fluid container, wherein an interior space of the one or more fluid containers is in fluid communication with the annular space via one or more respective outlet openings of the one or more containers, b) lowering the injecting tool body into the wellbore or the well tubular to a predetermined position, c) exposing at least part of an outside of the container walls to a surrounding pressure in the wellbore via openings in the injecting tool body, d) allowing at least part of each of the one or more fluid containers walls to displace within the tool body under forces exerted on the container walls by the surrounding pressure in the wellbore, e) pumping the one or more treatment fluids from each of the one or more fluid container into the wellbore or the well tubular via the one or more respective outlet openings of the one or more containers.

2. The method according to claim 1, wherein at least two different treatment fluids are injected, the method further comprising the step of:

pumping each of the at least two treatment fluids out of each of the one or more fluid containers in a predetermined volume relative to each other.

3. The method according to claim 2, further comprising connecting one or more respective pumps to each of the one or more fluid containers.

4. The method according to claim 3, further comprising pumping each of the at least two treatment fluids with positive displacement pumps.

5. The method according to claim 4, further comprising driving the one or more respective pumps connected to the one or more fluid containers and the positive displacement pumps with a single motor .

6. The method according to claim 5, wherein the separate pumps connected to each of the one or more fluid containers and the positive displacement pumps are connected to the single motor via a drive shaft , and wherein the respective pumps are selected having a pre-determined displacement of fluids per revolution of the drive shaft being relative to each other by a same ratio as defined by the pre-determined volume of the fluids.

7. The method according to claim 1, wherein the container walls of the fluid containers are elastic or plastic deformable and collapsible under the surrounding pressure in the wellbore.

8. A downhole tool for providing one or more seals at a pre-determined position in a wellbore in an annular space between a well tubular and a surrounding formation or between pipes of a wellbore, said downhole injecting tool comprising:

at least one fluid container having a fluid container outlet connected to a pump and a motor arranged within the downhole injecting tool for pumping fluid out of the at least one fluid container and into the wellbore, and where the at least one fluid container comprises container walls surrounding the at least one fluid in the at least one fluid container, and wherein the downhole injecting tool is constructed such that at least part of an outside of the container walls is open to ambient pressure surrounding the downhole injecting tool, and the at least part of the outside of the container walls is displaceable within the downhole injecting tool.

9. A downhole injecting tool according to claim 8, wherein the at least one fluid container and the pump and motor are arranged inside an injection tool casing, the injection tool casing having openings allowing the ambient pressure to reach at least part of an inner region of the injecting tool casing that contains the fluid containers.

10. A downhole injecting tool according to claim 9, comprising at least two fluid containers, and where separate pumps are connected to each of the at least two fluid containers.

11. A downhole injecting tool according to claim 10, wherein the pumps are positive displacement pumps.

12. A downhole injecting tool according to claim 11, wherein a single motor is arranged for driving the pumps.

13. A downhole injecting tool according to claim 12, wherein each of the separate pumps has a drive shaft connected to the motor, and where a displacement volume per revolution of each of the separate pumps is defined by a selected mixing ratio between fluids of the at least one fluid in the fluid containers.

14. A downhole injecting tool according to one of claim 9, wherein at least part of the container walls on the fluid containers are elastic or plastic deformable and collapsible under the ambient pressure.

15. A downhole injecting tool according to claim 14, wherein each fluid container is formed as a cartridge having a pipe having a first end extending inside the fluid container and through the container wall, and another end on the outside of the container, the other end of the pipe forming the outlet of the fluid container.

16. A downhole injecting tool according to claim 15, wherein a plurality of holes are made in the pipe at different positions along the first end in order to allow fluid in the fluid container to enter into the pipe.

* * * * *